US006689033B2

(12) United States Patent
Plemons et al.

(10) Patent No.: US 6,689,033 B2
(45) Date of Patent: Feb. 10, 2004

(54) CONTAINER FORMING METHOD AND APPARATUS

(76) Inventors: William E. Plemons, 2398 Golden State Blvd., Fowler, CA (US) 93625; Richard Bowers, 2398 Golden State Blvd., Fowler, CA (US) 93625; Ezra E. Theys, 3706 Kenwood Ave., San Mateo, CA (US) 94403; Ronald E. Heiskell, 51 Wimbledon La., Tracy, CA (US) 95376

( * ) Notice: Subject to any disclaimer, the term of this patent is extended or adjusted under 35 U.S.C. 154(b) by 0 days.

(21) Appl. No.: 09/861,123

(22) Filed: May 18, 2001

(65) Prior Publication Data

US 2002/0013204 A1 Jan. 31, 2002

Related U.S. Application Data

(63) Continuation of application No. 09/325,999, filed on Jun. 4, 1999, now Pat. No. 6,312,369.

(51) Int. Cl.[7] ..... B31B 1/60

(52) U.S. Cl. ..... 493/84; 493/906; 493/136; 493/137

(58) Field of Search ..... 493/84, 136, 137, 493/374, 390, 906

(56) References Cited

U.S. PATENT DOCUMENTS

| | | | | |
|---|---|---|---|---|
| 2,987,973 A | | 6/1961 | Chandler | |
| 3,713,579 A | | 1/1973 | Chaffers | |
| 3,858,489 A | | 1/1975 | Paxton | |
| 3,935,798 A | | 2/1976 | Paxton | |
| 4,028,999 A | | 6/1977 | Lee | |
| 4,173,173 A | | 11/1979 | Mims | |
| 4,211,358 A | | 7/1980 | Crane | |
| 4,277,015 A | | 7/1981 | Crane | |
| 4,283,188 A | | 8/1981 | Wingerter | |
| 4,291,830 A | | 9/1981 | Sorensen | |
| 4,304,351 A | | 12/1981 | Stollberg | |
| 4,464,155 A | | 8/1984 | Collura | |
| 4,482,074 A | | 11/1984 | Lalley | |
| 4,497,408 A | | 2/1985 | Jes | |
| 4,637,544 A | | 1/1987 | Quercetti | |
| 4,645,122 A | | 2/1987 | Nederveld | |
| 4,656,810 A | | 4/1987 | Plaskett | |
| 4,884,739 A | | 12/1989 | Nederveld | |
| 5,289,970 A | | 3/1994 | McClure | |
| 5,316,207 A | | 5/1994 | Ross et al. | |
| 5,390,847 A | | 2/1995 | Young | |
| 5,497,939 A | | 3/1996 | Heiskell | |
| D369,104 S | | 4/1996 | Heiskell | |
| 5,613,933 A | | 3/1997 | Pierce, Jr. | |
| 5,729,964 A | * | 3/1998 | Palmer | 53/484 |
| 6,312,369 B1 | * | 11/2001 | Plemons et al. | |

* cited by examiner

*Primary Examiner*—Eugene Kim
(74) *Attorney, Agent, or Firm*—Mark D. Miller

(57) ABSTRACT

Disclosed is a new machine for forming containers of the type described in U.S. Pat. No. 5,497,939 without the use of glue or nails. The machine utilizes a mandrel movably mounted on a path for oscillation between retracted and extended positions. As the mandrel cycles forward, it first receives two synthetic sidewalls and then a deformable body panel of the container to be formed. Then a set of moveable upper and lower rockers containing unique pressure mechanisms press tabs on the horizontally oriented portion of the wrap into corresponding locking slots on the ends of the sidewalls. When the mandrel is fully extended, pressure is applied to the tabs on the vertically oriented middle section of the wrap using a pair of hinge-mounted pressure plates fitted with unique biased brackets. The resulting container is removed from the machine, which is then ready to begin another cycle.

3 Claims, 13 Drawing Sheets

CONTAINER FORMING METHOD AND APPARATUS

This application is a continuation of Ser. No. 09/325,999 filed on Jun. 4, 1999 now U.S. Pat. No. 6,312,369.

BACKGROUND OF THE INVENTION

1. Field of the Invention

The present invention relates to container forming machines, and in particular to a new method and apparatus for forming containers of a type having rigid sidewalls that are uniquely attached to a central fiberboard or plastic wrap.

2. Description of the Prior Art

A wide variety of paperboard shipping and storage containers are known in the art. An equally wide variety of container forming machines are also known in the art. Among the more common uses of such containers are for the packing, shipment and storage of fresh fruit and vegetables, and for the storage and shipment of pre-packaged goods (e.g. cans of soup, bottles of beverages, jars of jelly, bags of rice, cartons of cereal, etc.). Such containers are typically made from paperboard materials such as, without limitation, single face corrugated, single wall (double-faced) corrugated, double wall corrugated, triple wall corrugated, container board, boxboard, linerboard, fiberboard and cardboard. There are many well known container styles that have been developed over the years, each being optimally suited for one or more particular products or industries.

Shipping and storage of fresh fruits such as table grapes pose particular problems because of the delicate nature of fruit, the cold temperatures in which the fruit is stored, and the need to pack, ship and store large quantities of fruit in reasonably sized containers.

Many paperboard containers have reinforced sides or end panels in order to improve stacking strength, such as that disclosed in U.S. Pat. No. 4,905,834. However, even with such reinforcements, these containers still suffer from significant stacking strength limitations because they are made of paperboard. The paperboard could easily become wet from such sources as rain, condensation in cold storage, ruptured fresh fruit, or the like, thereby losing stacking strength. Adding wax to such paperboard may improve resiliency, but also renders the paperboard container unrecyclable.

One known shipping container provides one or more fiberboard panels between two wooden end plates, the panels being nailed to the end plates. While the use of wood improves stacking strength of the container, such containers tend to slide against each other, particularly in taller stacks. In addition, the wooden end plates in the container may damage the fruit, the wood is expensive, and disengaging the nails and fiberboard from the wood panels is cumbersome, making such containers difficult to reuse or recycle. Replacing the wooden side panels of such containers with injection molded polypropylene can reduce the cost, but does not resolve the sliding problem, and exacerbates the recycling problem.

In response to these problems, a new container has been developed which is the subject of U.S. Pat. No. 5,497,939. This new container uses two specially designed plastic sidewalls (end panels) and a panel for attachment between them. Each plastic sidewall has stacking tabs on the top, corresponding receiving slots on the bottom, and a set of locking slots on the bottom and side edges thereof. The attachable panel includes a series of protruding lockable tabs along its sides, each tab having at least one opening therein. The panel is positioned between the two sidewalls such that the edges of the panel wrap around the sidewalls, the tabs on the panel engaging with the locking slots on the sidewalls to form a sturdy, stackable container. Forming such a container without the use of adhesives or nails allows the panel wrap to be cleanly and easily disengaged from the sidewalls, thereby allowing the wrap to be recycled and the sidewalls to be reused. Accordingly, a method and apparatus are needed to form the unique containers of U.S. Pat. No. 5,497,939.

In particular, such containers require an apparatus which is capable of firmly holding the plastic sidewalls in place, attaching the panel wrap to the sidewalls by engaging the tabs on the wrap with the locking slots on the bottom and side edges of the sidewalls, and preventing the central portion of the panel wrap from being bent or deformed—all without using adhesives or nails.

Virtually all paperboard machines use adhesives to bond the various pieces of the paperboard container together. Some machines fold a single paperboard blank into a container having a particular shape, such as that shown in U.S. Pat. No. 3,858,489; and others fold and eventually join together two or more paperboard pieces to form the container, such as that shown in U.S. Pat. No. 4,238,188.

U.S. Pat. No. 4,637,544 discloses a container box having two synthetic side walls connected by a folded sheet of cardboard. However, both side walls include U-shaped grooves recessed in the faces thereof for receiving the edges of the folded cardboard piece. A set of teeth found in the grooves are used to fasten the side walls to the folded cardboard piece. Thus, the cardboard piece must first be folded and placed in an exact position, then each of the side walls must be precisely inserted over the ends of the folded piece in order for the edges of the piece to fit into the grooves and engage the teeth. This patent does not disclose any apparatus for accomplishing this task. By contrast, the panel of the container formed by the present invention interlocks with locking slots on the exterior edge surfaces of the sidewalls, by engages a series of panel tabs with locking slots in the sidewalls.

SUMMARY OF THE INVENTION

The present invention provides a method and apparatus for forming containers of the type described which utilizes a mandrel movably mounted on a path between retracted and extended positions. The cycle for forming a container begins with full retraction of the mandrel. After being retracted, the mandrel moves forward to first receive the two synthetic sidewalls of the container to be formed, one on either side. The sidewalls are firmly compressed against the mandrel using pressure plates on either side. A rectangular fiberboard or plastic body panel or panel wrap is placed in the path of the mandrel in a vertical orientation.

The panel wrap includes a plurality of tabs along the edges of its two longer sides. These tabs correspond to locking slots on the surfaces of the bottom and side edges of the sidewalls. Each tab has an opening therein for receiving a corresponding button located in each slot on the sidewall. A series of plows and shoes are provided above and below the path of the mandrel on the other side of the wrap. As the mandrel moves forward, it pushes into the middle of the wrap. At the same time, the plows and shoes bend the upper and lower portions of the wrap into a more horizontal orientation, leaving the middle of the wrap in a vertical position. As the mandrel continues forward, the outside edges of the wrap come into contact with the exterior surface edges of the two sidewalls. As described more fully in the '939 container patent, each of the sidewalls includes a plurality of locking slots or recesses with buttons therein on its outer edges for engagement with the tabs and openings of the panel wrap. In a typical embodiment, there are two (2) such recess-and-button areas on either end of each side panel, and three (3) such areas on the bottom of each panel.

As the wrap is pushed through the machine, a set of moveable upper and lower rockers press the panel wrap tabs on the horizontally oriented portion of the wrap into the locking slots on the ends of the sidewalls with sufficient pressure to not only force the tabs into the slots, but to also push the tabs onto the sidewall buttons such that the buttons extend through the openings in the body panel tabs. This pressure occurs as the container parts pass through the rockers. As a result, the tabs in the horizontally oriented (bent) portions of the wrap are locked to the upper and lower edges of the sidewalls.

Then, when the mandrel is fully extended, pressure is applied to the tabs on the vertically oriented middle section of the wrap (which will form the bottom of the container to be formed) in order to lock the remaining panel wrap tabs in this section to the corresponding slots and buttons on the bottom edges of the two sidewalls. Pressure is applied to these remaining tabs using a pair of hinge-mounted pressure plates fitted with unique biased brackets, each plate providing pressure to the tabs on one side of the wrap. The brackets push the tabs into the corresponding sidewall locking slots with sufficient force to also push the buttons through the holes in the tabs. The sidewalls are then released by the mandrel, the hinged end plates are opened, and the resulting container is removed from the machine. The mandrel is then fully retracted, and the machine begins another cycle. The result is a container constructed without the use of glue or nails that is very strong, and which is ready to be loaded, closed, stacked and shipped.

Other unique features of the machine include offset shoes or plows which provide unique engagement of the panel wrap both above and below the sidewall areas. These offset shoes prevent the open area of the panel wrap between the sidewalls from being bent or deformed as the tabs are locked to the sidewalls. Also unique is a brace on each side which holds the sidewall in place against the mandrel and securely aligns it as it passes between the pressure rockers. These braces prevent the sidewalls from slipping or shifting in order to assure that the panel wrap tabs line up with the locking slots in the sidewalls and to assure that the buttons in the sidewalls line up with the openings in the tabs. Another unique feature is the use of cables to transmit and/or impart motion from one or more centrally rotating cams out to the rockers and pressure plates of the machine.

It is therefore a primary object of the present invention to provide a method and apparatus for forming containers having two plastic sidewalls attached to a central plastic or fiberboard panel wrap without the use of adhesives or nails.

It is also an important object of the present invention to provide a method and apparatus for forming containers having two plastic sidewalls having a plurality of recesses and buttons on their peripheral edges that are engaged with a plurality of corresponding tabs with openings located along the edges of a plastic or fiberboard panel wrap.

It is another object of the present invention to provide a method and apparatus for forming containers of a type having two plastic sidewalls attached to a central panel wrap which causes a plurality of tabs with openings thereon located on the wrap to be engaged with a plurality of corresponding recesses and buttons located on the sidewalls for firm attachment of the panel to the sidewalls without the use of nails or glue.

It is also an important object of the present invention to provide a method and apparatus for forming containers of the type described above which containers may be easily disassembled for recycling and/or reuse of the panel wrap and sidewalls.

It is also an important object of the present invention to provide a method and apparatus for forming containers of the type described above which include tabs and slots at the tops and bottoms thereof, respectively, which allow for tall and stable stacking of such containers.

It is also an important object of the present invention to provide a method and apparatus for forming containers of the type described above which containers are resistant to damage or collapse caused by moisture.

It is also an important object of the present invention to provide a method and apparatus for forming containers of the type described above which utilizes offset shoes to prevent deformation of the panel as the tabs thereon are engaged with the sidewalls.

It is also an important object of the present invention to provide a method and apparatus for forming containers of the type described above which utilizes a brace for securely holding the sidewalls in place as pressure is applied to attach the panel wrap tabs to the recesses and buttons thereon.

It is also an important object of the present invention to provide a method and apparatus for forming containers of the type described above which utilizes unique cabling to impart motion from rotating cams to various distant operating parts of the machine.

It is also an important object of the present invention to provide a method and apparatus for forming containers of the type described above which utilizes unique pressure rockers to attach the tabs and openings on the horizontally oriented panel sections to the corresponding locking slots and buttons on the sidewalls.

It is also an important object of the present invention to provide a method and apparatus for forming containers of the type described above which utilizes unique pressure plates and brackets to attach the tabs and openings on the vertically oriented panel wrap sections to the corresponding recesses and buttons on the sidewalls.

Other objects of the invention will be apparent from the detailed descriptions and the claims herein.

DETAILED DESCRIPTION OF THE DRAWINGS

Figure 1:
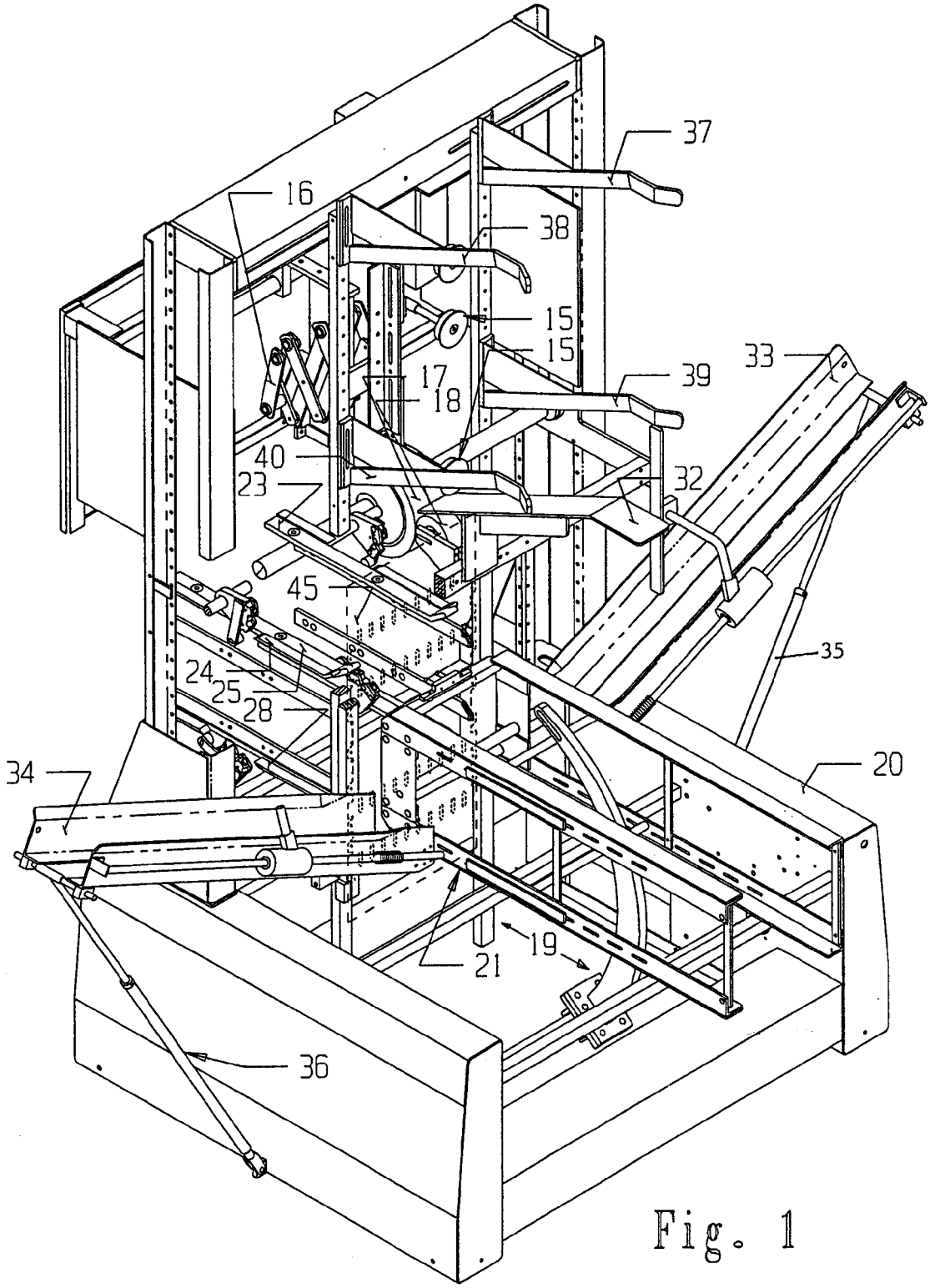
FIG. 1 is a greatly simplified front perspective view of the chassis of the invention.
Figure 2:
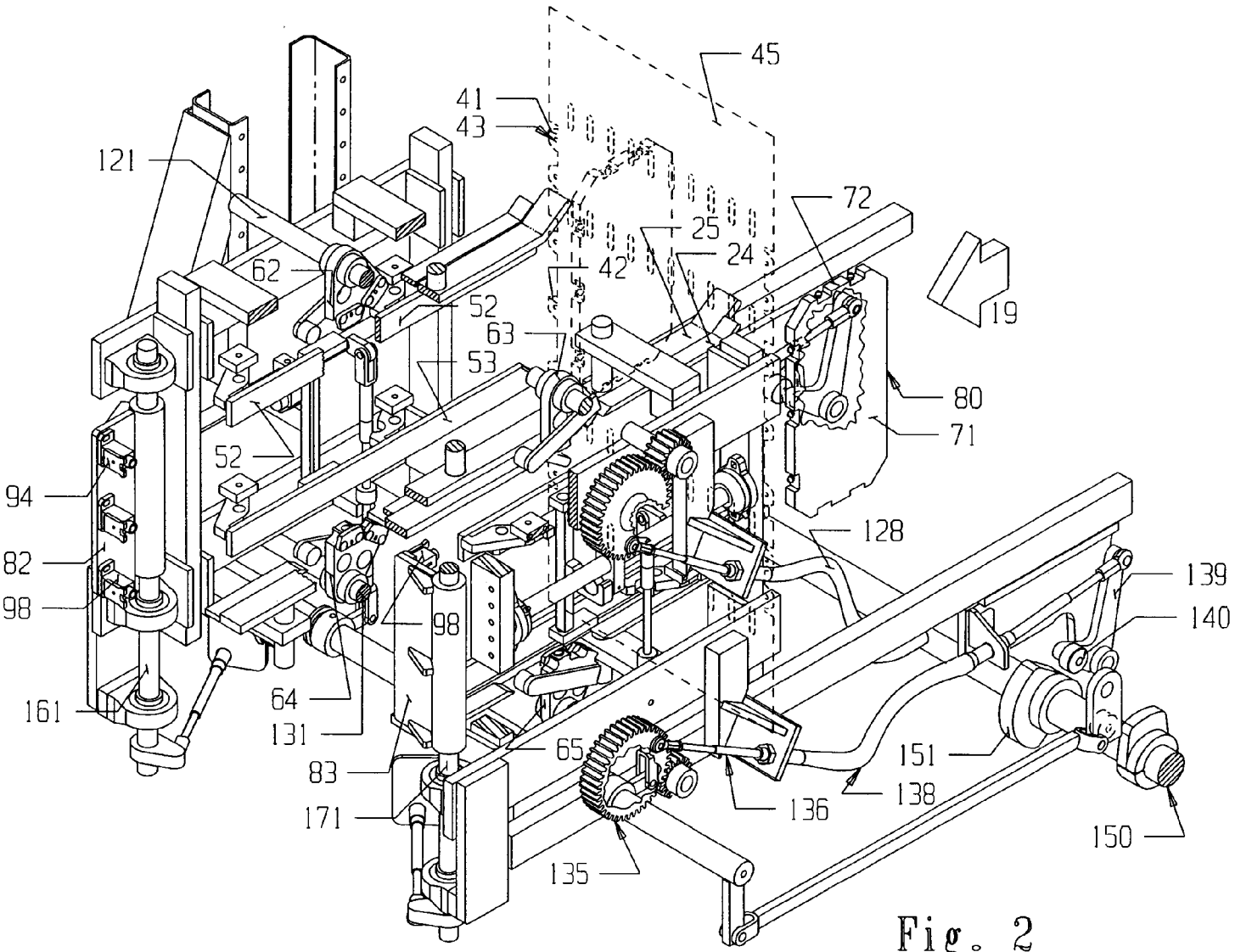
FIG. 2 is a somewhat simplified partially cut-away back perspective view of the operating mechanism of the present invention.

Referring to the drawings wherein like reference characters designate like or corresponding parts throughout the several views, and referring particularly to FIGS. 1 and 2 it is seen that the invention includes a mandrel 20 that is movable between a retracted position at the front of the machine and an extended position at the back of the machine. Along the path 19 of the mandrel the following general operating stages-are provided: (a) the sidewall delivery units, generally represented by adjustable hoppers 33 and 34; (b) an overhead panel wrap feed mechanism, generally represented by guides 32 and 37–40; (c) a set of container forming plows and shoes, generally 22–29; (d) a set of sidewall braces, generally 52–55; (e) a set of pressure rockers, generally 62–65; and (f) a pair of hinged end pressure plates, generally 82–83.

As mandrel 20 cycles forward, the first stage it encounters are the sidewall delivery units. Two pivotally attached sidewall hoppers 33 and 34 are provided, one on each side of the mandrel, mounted on an adjustable length arm 35, 36. Stacks of sidewalls 71 are loaded sideways into hoppers 33 and 34, with the bottom most sidewalls in the position shown in FIG. 11. In particular, sidewalls 71 are oriented in hoppers 33 and 34 such that their end surfaces 72 containing locking slots 75 and buttons 76 are parallel to the path of travel of mandrel 20 (see directional arrow of FIG. 11); the top edges 80 of the sidewalls with stacking tabs 73 are oriented perpendicular to the path of the mandrel, so that they face the oncoming mandrel; and the bottom surfaces 74 of the sidewalls containing locking slots 77 and buttons 78 are oriented perpendicular to the path of the mandrel, so that they face away from the forward moving mandrel.

During each cycle of the machine, two sidewalls 71 are removed, one from each hopper on each side, and brought forward by the mandrel. Both sides of mandrel 20 are provided with pointed picks 21 which pierce the surfaces of sidewalls 71 to hold them in place against the mandrel as it moves forward (see detail, FIG. 3). These picks work in conjunction with the plows, shoes and braces of later stages to keep the sidewalls in a proper orientation. As the machine repeats the cycle over and over, additional stacks of sidewalls 71 must be loaded into hoppers 33 and 34.

The second stage the mandrel encounters as it cycles forward is the panel wrap feed mechanism made up of support tongue 32, guides 37, 38, 39 and 40, and vacuum feed. These guides are capable of receiving and holding a stack of flat panel wraps 45, each wrap in a vertical orientation. A set of vacuum suction cups 15 are provided on an adjustable mount 16 adjacent to the lowermost position of guides 37–40. Suction is applied to cups 15, and mount 16 extends the cups out to pick off the lowermost wrap 45 from the stack. The motion of mount 16 places wrap 45 between rotatable wheels 17 and 18. The rotation of these wheels delivers the wrap 45 is in front of retracted mandrel 20 before it begins its next forward cycle, this position being shown by the phantom lines in FIG. 1. This is also the position shown in FIG. 11. The mandrel picks up this wrap 45 and brings it forward along with the sidewalls 71 it has already picked up from hoppers 33 and 34. The wraps 45 can be made of any suitable material including without limitation plastic, fiberboard, corrugated, cardboard, and the like.

Figure 11:
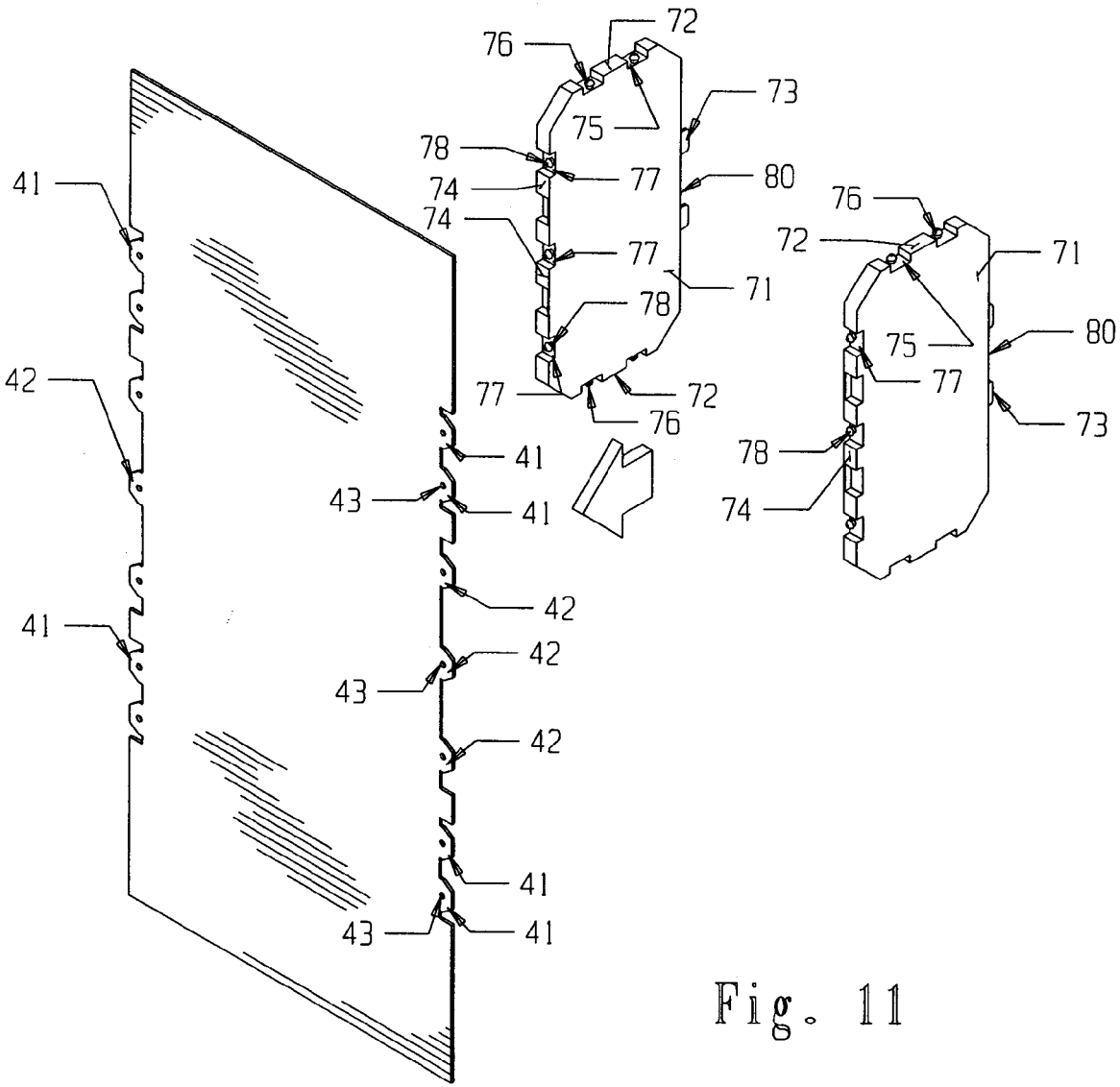
FIG. 11 is a view of the panel wrap and sidewalls showing their respective positions in the machine of the invention (without showing the machine itself) prior to the forward cycle of the mandrel.

As shown in FIG. 11, each wrap 45 includes a plurality of tabs 41 and 42 along its two longer parallel sides. Each of tabs 41 and 42 has an opening or hole 43 therein. End tabs 41 are positioned for engagement with end locking slots 75 in sidewalls 71. Bottom tabs 42 are positioned for engagement with bottom locking slots 77 in sidewalls 71.

Figure 9:
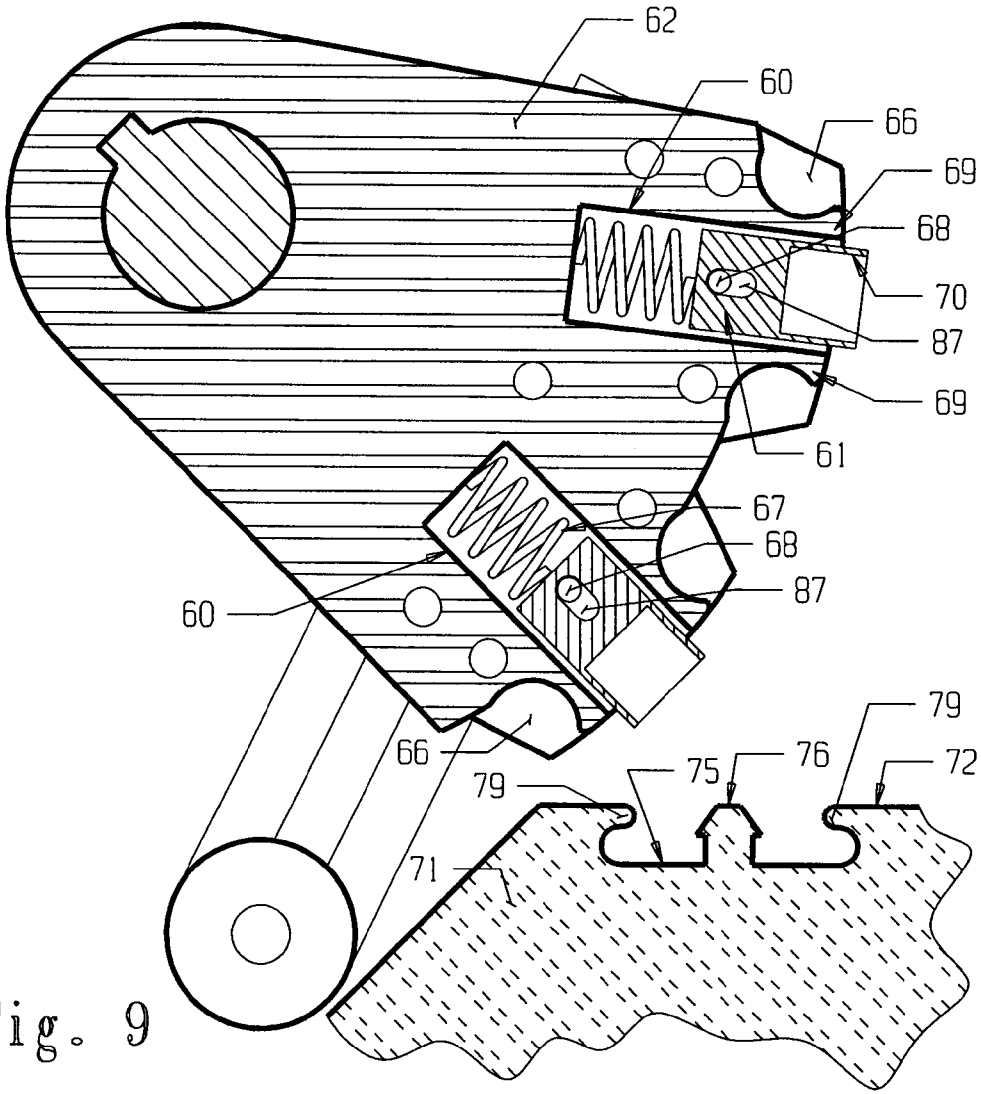
FIG. 9 is a cross-sectional side view of the pressure rocker of FIG. 8 also showing detail of a sidewall.
Figure 10:
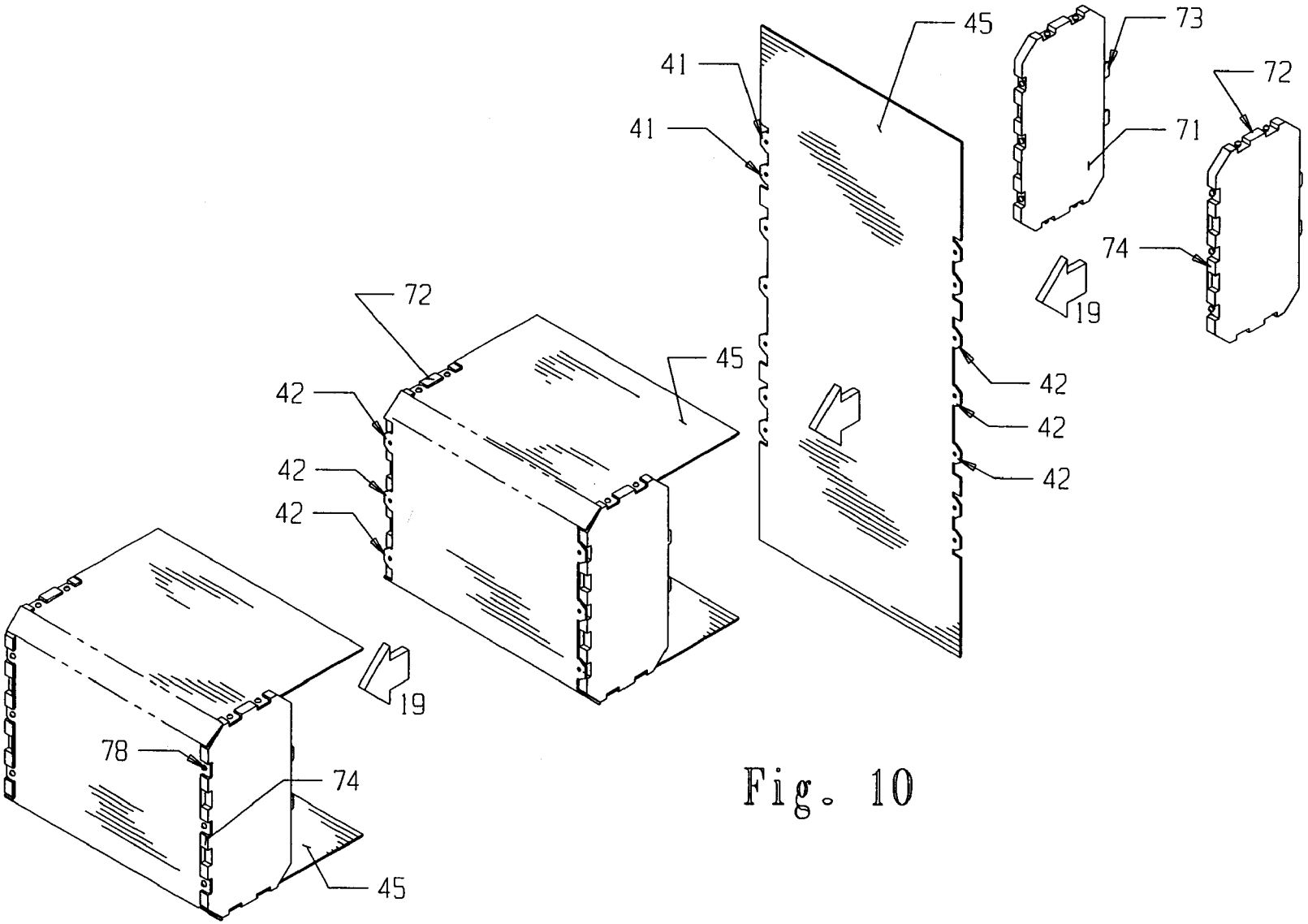
FIG. 10 is a series of isometric views of the container parts showing the stages of formation by the machine of the present invention.

In particular, each locking slot 75 and 77 includes a pair of small lips or flanges (extensions) 79 which make the outer openings of slots 75 and 77 slightly more narrow than the interiors of the slots themselves (see detail in FIG. 9). Tabs 41 and 42 are approximately the same size as slots 75 and 77, but are wider than the narrow openings in these slots created by flanges 79. Accordingly, once a tab 41 or 42, respectively, is inserted by squeezing through flanges 79 into slot 75 or 77, respectively, flanges 79 "lock" the tab in place preventing it from being removed.

The third stage the mandrel encounters as it cycles forward is the wrap deforming area which includes a delay device and deforming shoes.

The wrap then encounters a plurality of primary shoes or plows 23, 25 and 27, 29. These are provided above and below the path of the mandrel for bending and deforming the upper and lower sections of wrap 45 as it is pushed forward by the mandrel (see FIGS. 3–5). A set of secondary shoes or plows 22, 24 and 26, 28 are provided immediately adjacent to and slightly offset from primary shoes 23, 25, 27 and 29, respectively. These secondary shoes guide the outside edges 72 sidewalls 71 (containing slots 75 and buttons 76) through the machine. Each of the primary and secondary shoes includes an outwardly angled section to facilitate the bending of wrap 45 and guidance of wrap 45 and sidewalls 71 as the mandrel pushes them through the machine.

Figure 4:
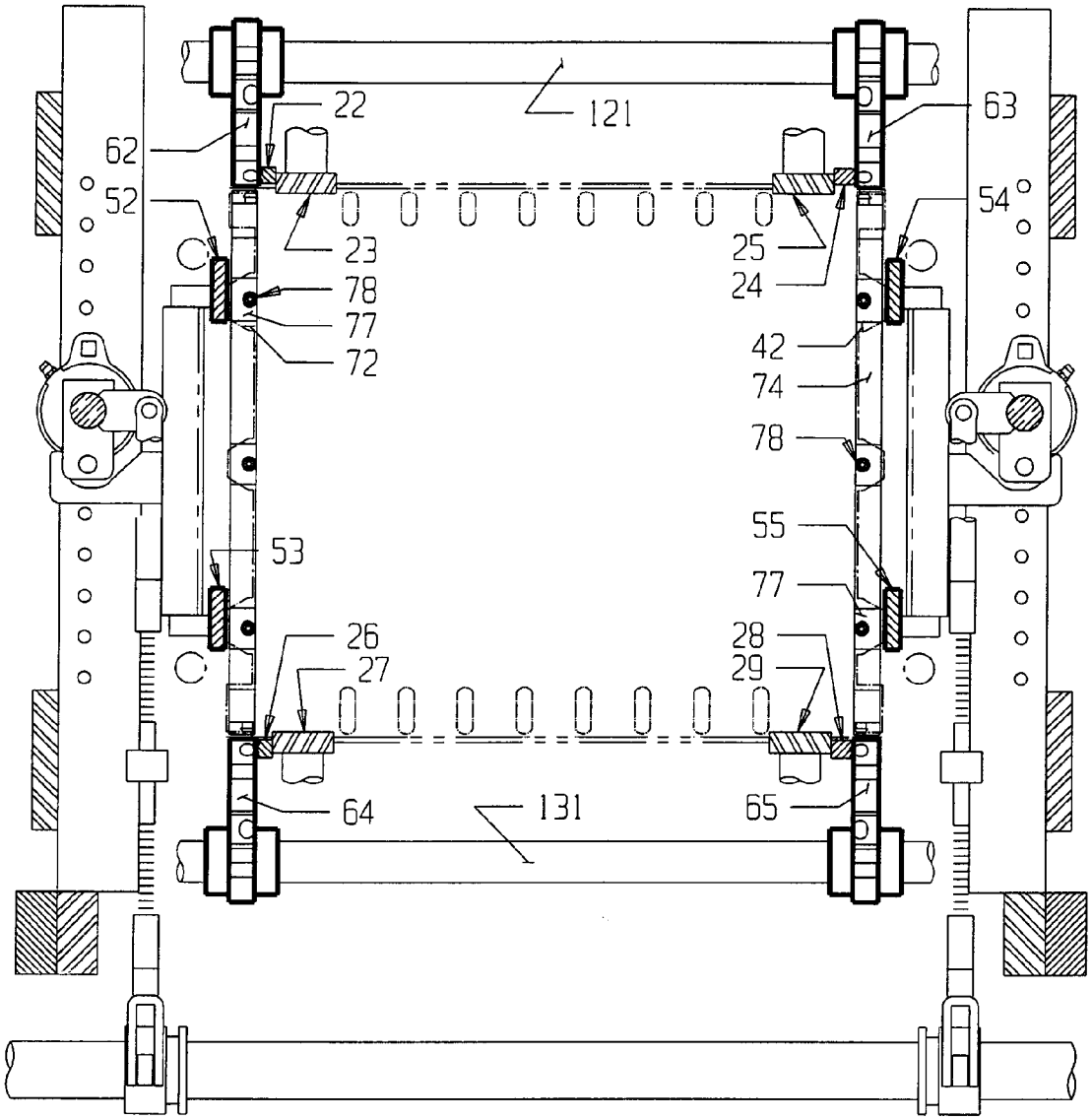
FIG. 4 is a cross-sectional cut-away end view of the invention shown in FIG. 3 with the panel wrap around the sidewalls.
Figure 5:
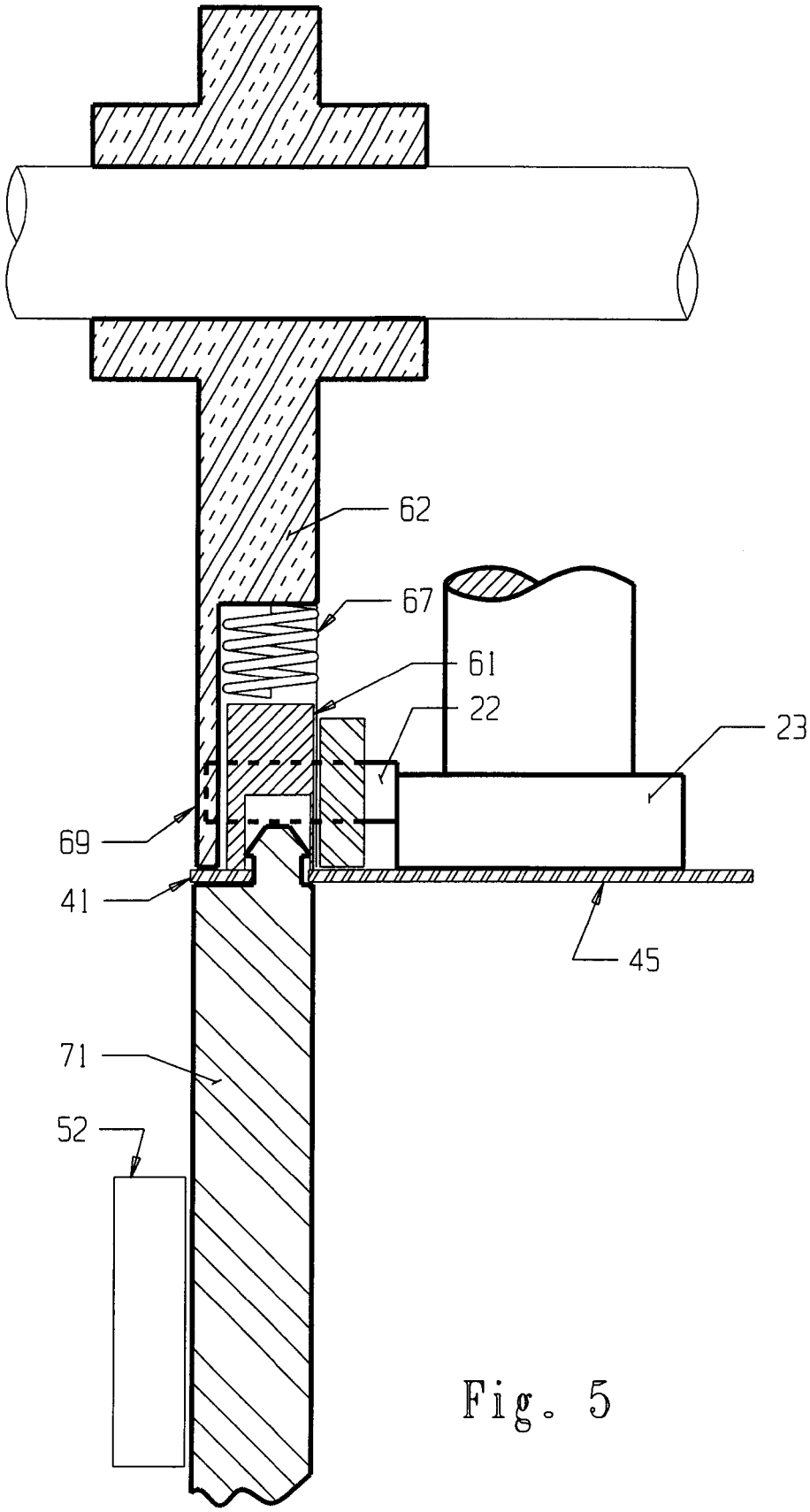
FIG. 5 is an enlarged cross-sectional end view of the button engagement mechanism of FIG. 4.

As the mandrel moves into the vicinity of primary and secondary shoes 22–29, it encounters the fourth stage made up of a set of four spring-loaded retractable braces 52–55 which are activated so that they press sidewalls 71 firmly against the sides of mandrel 20 (see FIGS. 4 & 5). Braces 52–55 are mounted at upper and lower positions along either side of mandrel 20. As mandrel 20 moves forward with sidewalls 71 affixed to either side using picks 21, the sidewalls rub against and slide along braces 52–55. Wrap tabs 42 also come into contact with these braces for alignment. The friction between the braces and the sidewalls 71 holds them securely in place for the next operation of the machine.

The fifth stage encountered by the forwardly cycling mandrel are the pressure rockers 62–65 best shown in FIG.

3. Two upper rockers 62 and 63 are provided above the path of the mandrel adjacent to shoes 23 and 25, respectively. Two lower rockers 64 and 65 are provided below the path of the mandrel adjacent to shoes 27 and 29, respectively.

Figure 8:
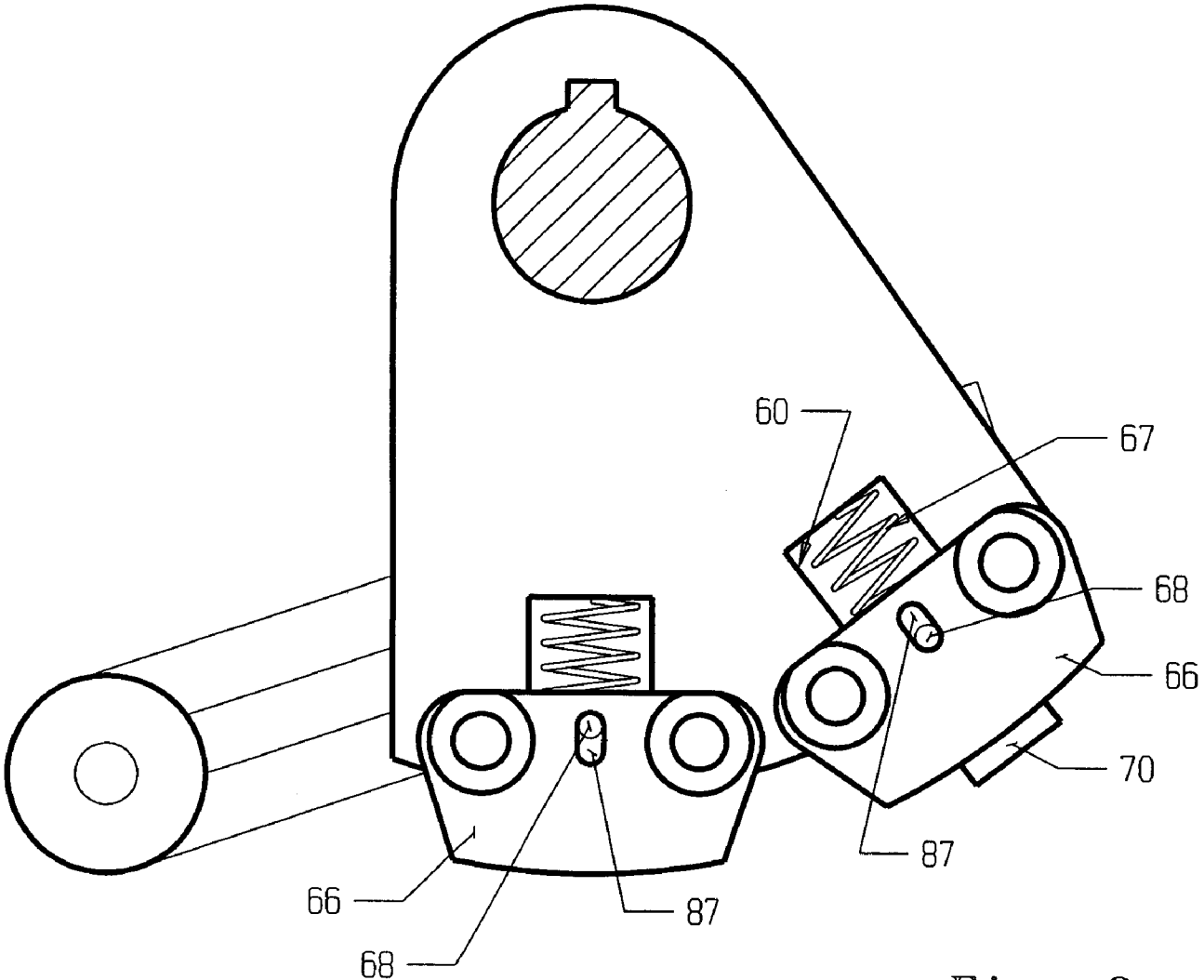
FIG. 8 is an enlarged side view of a pressure rocker.

Each rocker 62–65 is pivotally mounted on a rotatable shaft such that it moves in an arcuate path back and forth between two pre-defined positions (i.e. it "rocks"). Detail of the rockers and compression brackets is found in FIGS. 8 and 9. The description of each rocker 62–65 is the same. Each rocker (e.g. 62) includes a plurality of extensions 69 upon which are mounted resilient compression brackets 66. Each extension 69 and bracket 66 corresponds to a locking slot 75 on sidewall 71, and a tab 41 on panel wrap 45. Each bracket 62–65 includes an opening 60 into which a slidably mounted pressure imparting member 61 is provided. Pressure member 61 is attached at one end to a resilient member 67, in the form of a spring or other similar device, which in turn is captured on the inside of opening 60. The other end of pressure member 61 defines an annular flange 70 defining an opening. The flange 70 may be extended out away from bracket 66 because of the action of resilient member 67, but its path of travel is limited by a fixed pin 68. The opening inside annular flange 70 corresponds to the buttons 76 on sidewalls 71, and to the tab openings 43 on panel wrap 45.

As the mandrel pushes the deformed panel wrap 45 and the sidewalls 71 through the machine, tabs 41 on the panel wrap and locking slots 75 on-the sidewalls pass-between the rockers 62–65. Braces 52–55 and picks 21 hold the sidewalls firmly against the sides of the mandrel 20. The brackets 66 and extensions 69 on the rockers first come into contact with the tabs 41 on wrap 45. At this point, annular flanges 70 of pressure members 61 are extended out away from bracket 66 (as in FIG. 9). The annular flanges 70 then come into contact with the centers tabs 41 such that the annular openings inside flanges 70 are oriented directly above openings 43 on wrap 45, and likewise oriented above buttons 76 on sidewall 71.

Figure 12:
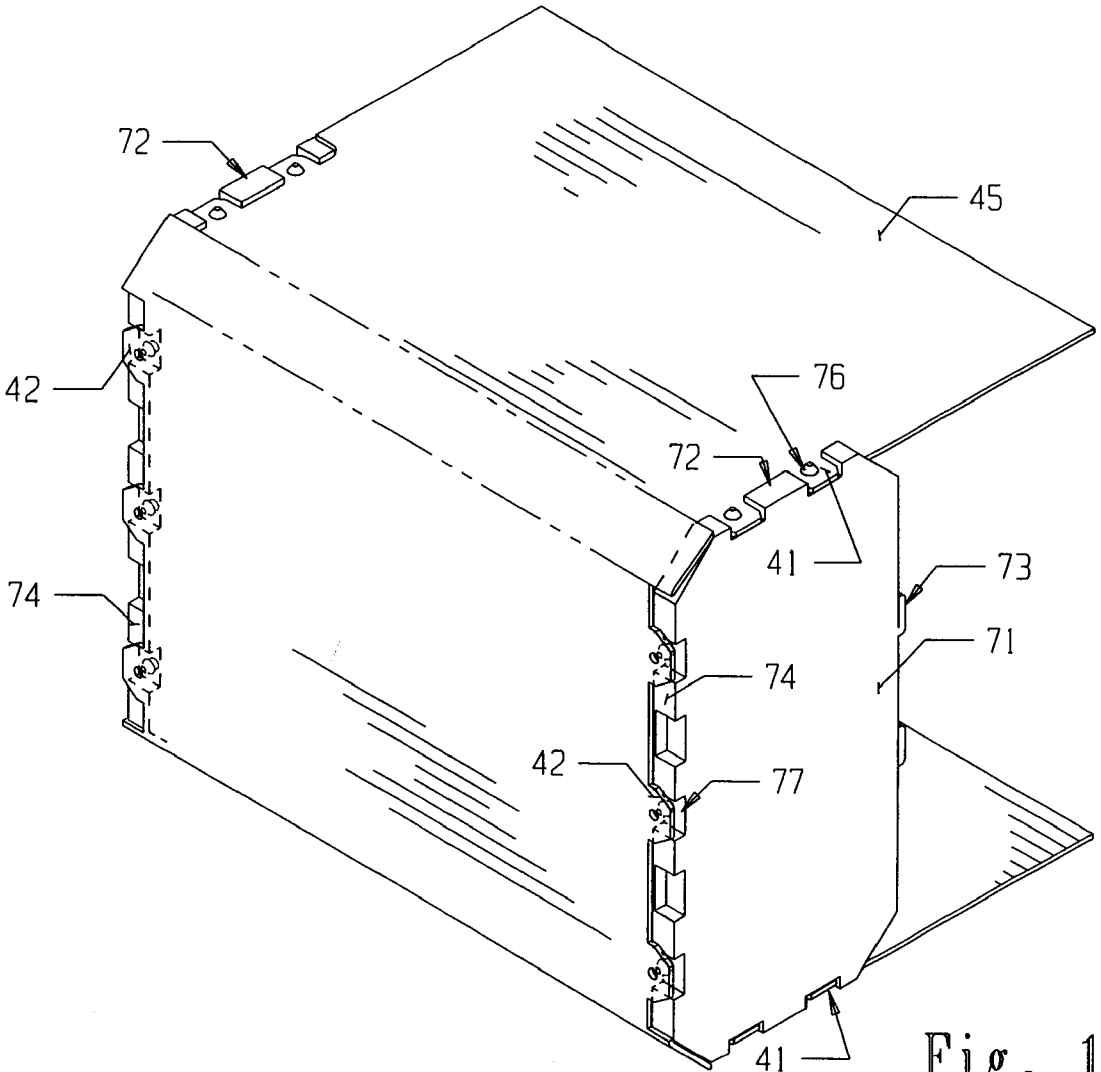
FIG. 12 is a view of the panel wrap and sidewalls showing their respective positions in the machine of the invention (without showing the machine itself) at mid-cycle, after engagement of the horizontal panel wrap tabs with the locking slots on the ends of the sidewalls.

As the mandrel 20 continues its forward motion, the rockers rotate on their pivotal axes in conformity with the motion of the mandrel so that brackets 66 and the pressure members inside them (61, 69 and 70) maintain their positions relative to the sidewall openings 75 and panel wrap tabs 41. As a result, the upper and lower rockers 62, 64 and 63, 65, respectively, squeeze tabs 41 into the recesses of slots 75 on the upper and lower ends of sidewalls 71. In particular, extensions 69 and brackets 66 press tabs 41 into slots 75. This securely locks tabs 41 into slots 75 by the action of flanges 79. At the same time, pressure members 61 with annular flanges 70 push the openings 43 of tabs 41 over buttons 76 providing further secure attachment (see FIGS. 5 and 12).

The last stage encountered by the forwardly moving mandrel includes a pair of hinged end plates 82 and 83, each plate having a set of pressure imparting brackets 91 attached thereto. Three such brackets 91 are shown on each of plates 82 and 83. Brackets 91 operate in a fashion that is similar (although not identical) to that of pressure rockers 62–65.

Figure 3:
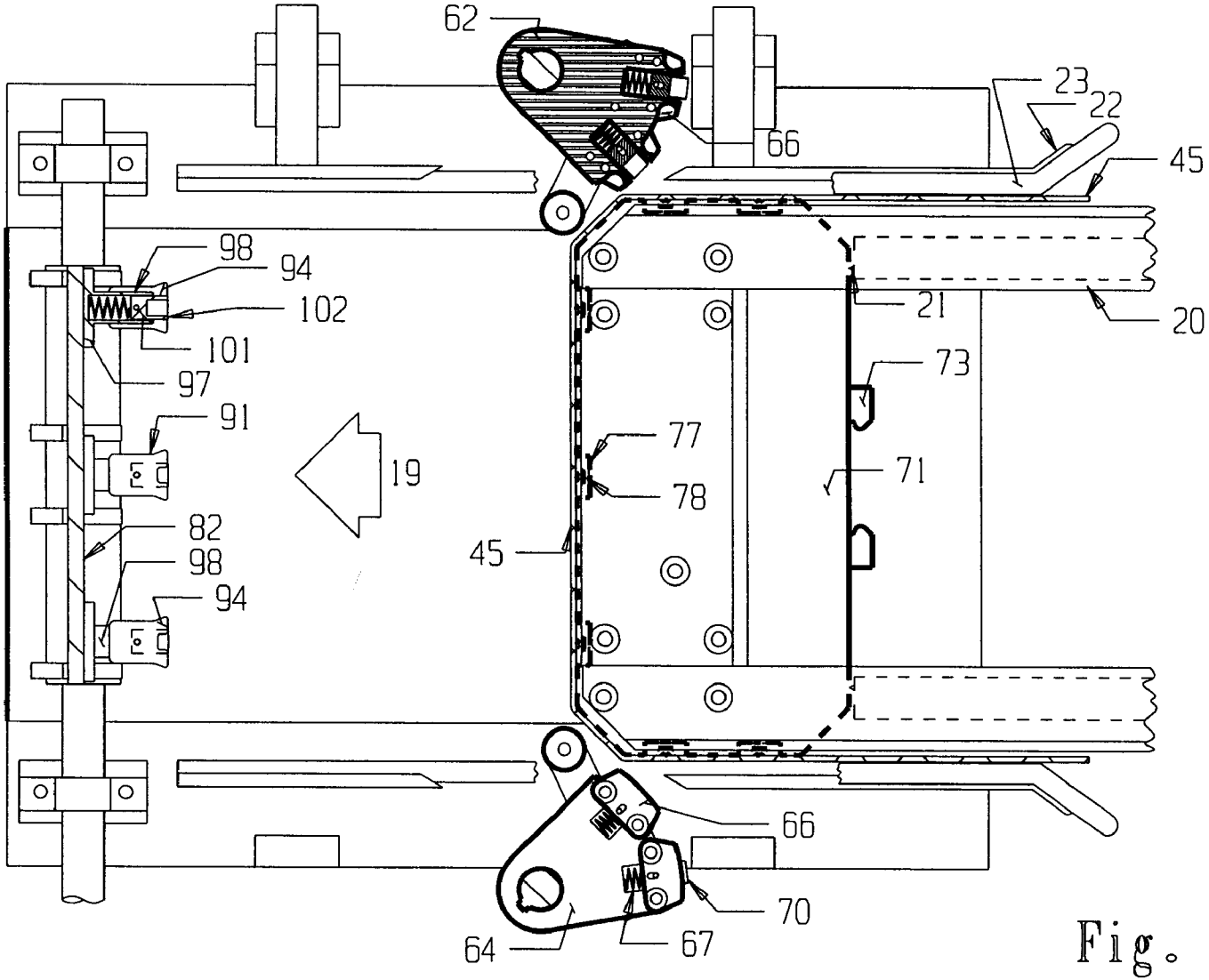
FIG. 3 is a cross-sectional cut-away side view of the invention showing the panel wrap around the sidewalls prior to locking engagement of the tabs and buttons.
Figure 7:
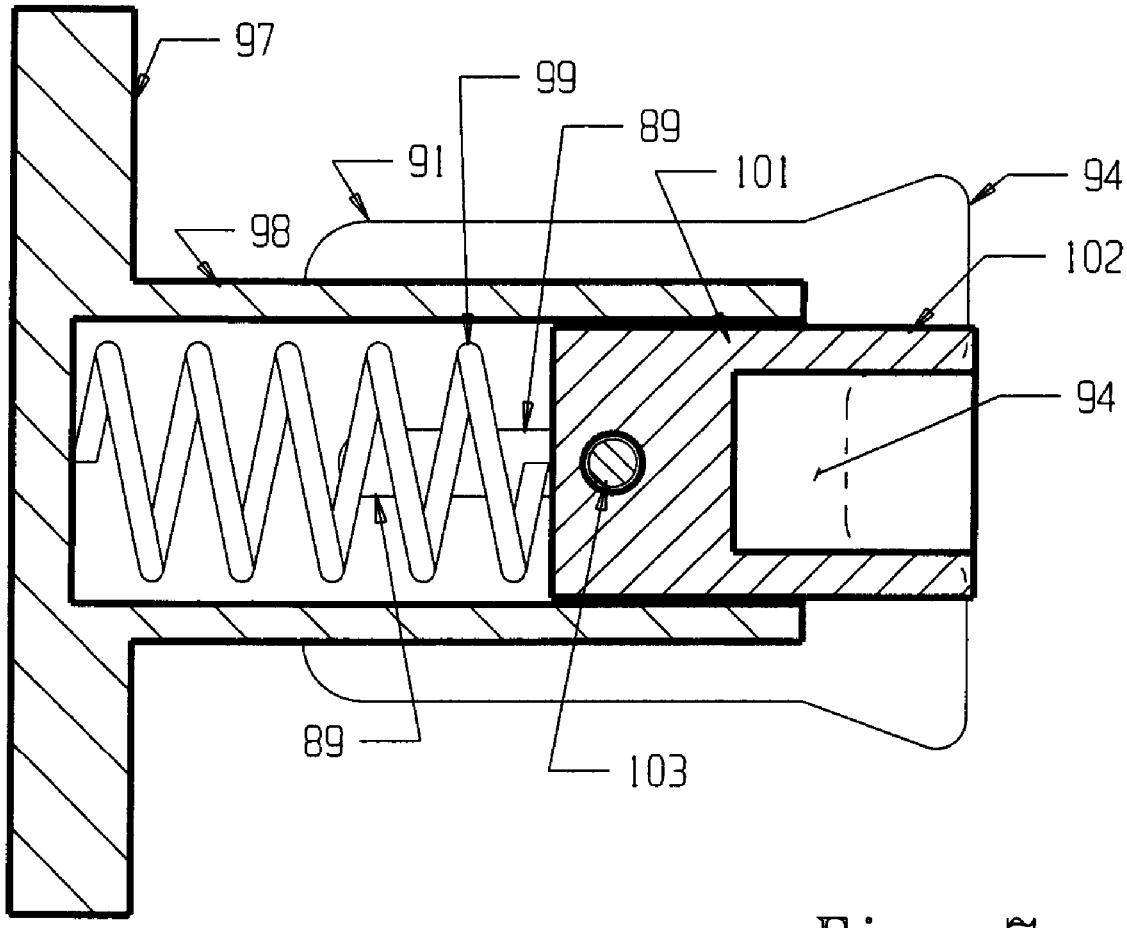
FIG. 7 is an enlarged cross-sectional view of a pressure bracket.

Referring to FIG. 3 and the detail of FIG. 7, it is seen that each bracket 91 includes a bell-shaped outer extension 94 attached to a T-shaped member 97 having an open ended body defined by legs 98. Each bracket 91 includes a cylindrical pressure imparting member 101 having an annular opening defined by flange 102, slidably mounted inside the open end of body 98. Pressure imparting member 101 is attached at one end to a resilient member 99, in the form of a spring or other similar device, which in turn is captured on the inside of the opening defined by body 98. The path of travel of member 101 is limited by pin 103.

Figure 13:
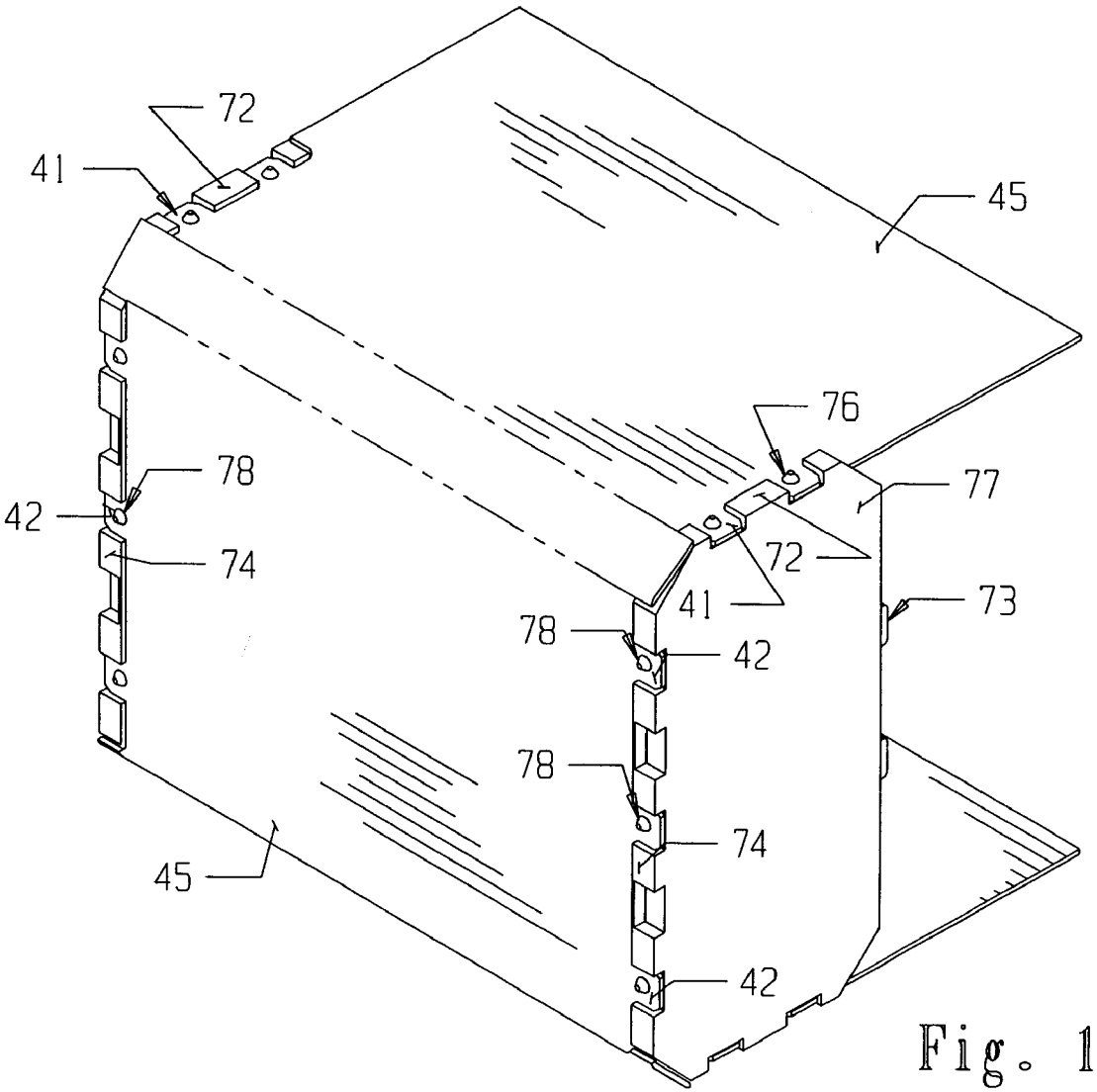
FIG. 13 is a view of the panel wrap and sidewalls showing their respective positions in the machine of the invention (without showing the machine itself) at full-cycle, after engagement of the vertical panel wrap tabs with the locking slots on the bottoms of the sidewalls.

Each body 98 and extension 94 corresponds to a locking slot 77 on sidewall 71, and a tab 42 on the bottom of panel wrap 45. The opening inside annular flange 102 corresponds to the buttons 78 on sidewalls 71, and to the tab openings 43 on panel wrap 45. In operation, panels 82 and 83 are closed so that brackets 91 face the oncoming mandrel 20 as it pushes the container parts forward. Upon contact, the flared bottoms of bracket extensions 94 push tabs 42 into slots 77. This securely locks tabs 42 into slots 77 by the action of flanges 79. At the same time, pressure members 101 with annular flanges 102 push the openings 43 of tabs 42 over buttons 78 providing further secure attachment (see FIG. 13).

The completed container is then ejected by a power out feed (not shown). This feed includes at least one slidably mounted member having an upwardly extending lip which oscillates between an extended and retracted position. When retracted, the lip catches against a bottom edge of the newly formed container. As the member slides forward, it ejects the container from the machine, and then retracts to pick up the next container.

Figure 6:
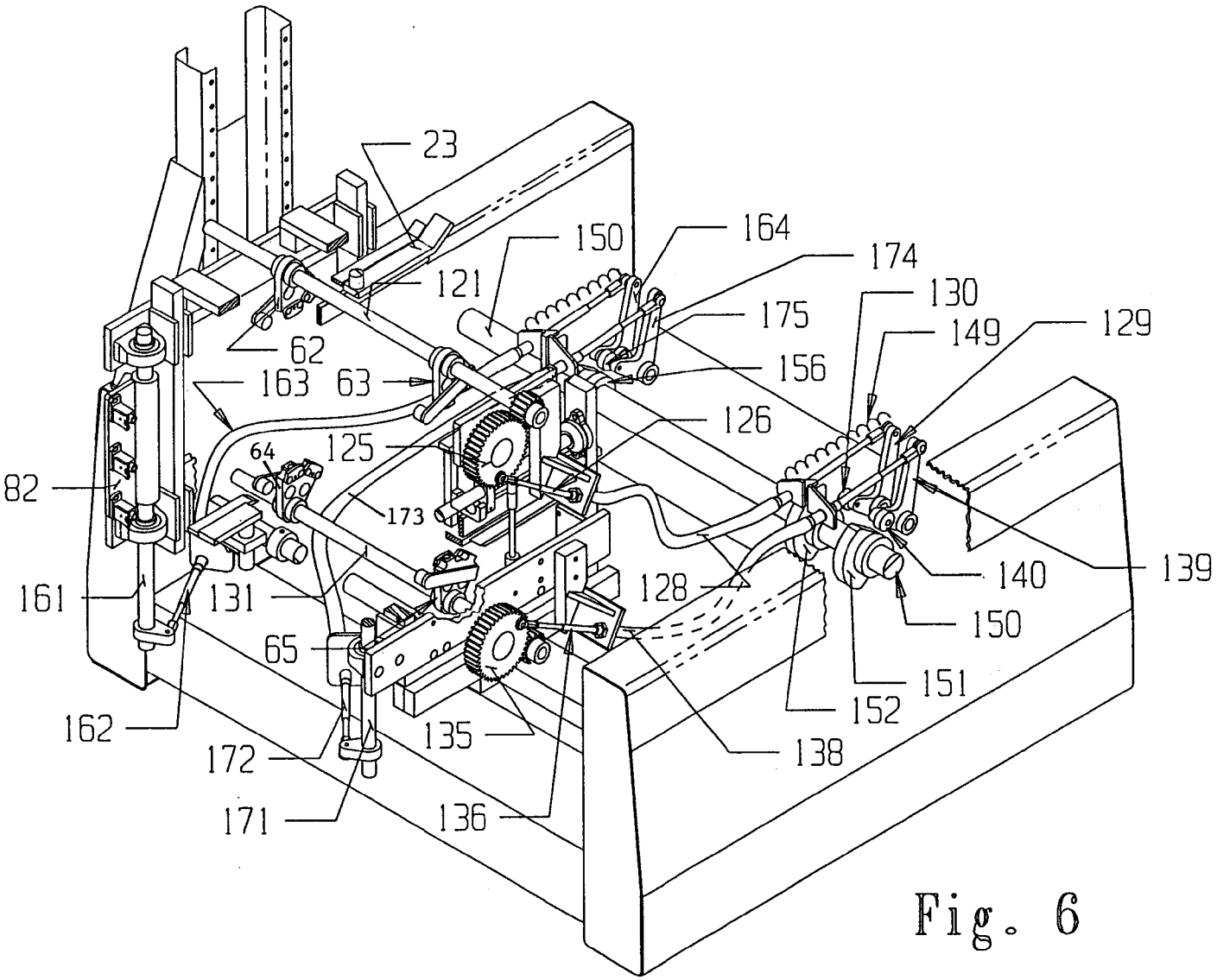
FIG. 6 is an enlarged partially cut-away isometric view showing the cabling system of the present invention.

The movement of the rockers 62–65 and pressure plates 82–83 is imparted through a cam and cable system shown in FIG. 6. Upper rockers 62 and 63 are mounted on pivotal rod 121, and lower rockers 64 and 65 are mounted on pivotal rod 131. Upper rod 121 is connected to gears 125 and adjustable linkages 126 to cable 128 leading to adjustable linkages 129 attached to cam follower 130 which follows cam 152 on rotatable rod 150. Similarly, lower rod 131 is connected to gears 135 and adjustable linkages 136 to cable 138 leading to adjustable linkages 139 attached to cam follower 140 which follows cam 151 on rotatable rod 150. As rod 150 rotates, so do cams 151 and 152. When cam followers 130 and 140 are moved by cams 151 and 152, the linkages, cables and gears transmit this movement to upper and lower rods 121 and 131, thereby moving rockers 62–65 forward. This motion is calibrated to coincide with the presence of mandrel 20 carrying wrap 45 and sidewalls 71 through the rockers. When the mandrel has passed through the rockers, cam followers 130 and 140 move back into place (cams 151 and 152 no longer imparting movement), and spring 149 moves rockers 62–65 back to their original positions.

The movement of pressure plates 82 and 83 occurs in a similar fashion. Plate 82 is attached to pivotal rod 161 which is connected via adjustable linkages 162 to cable 163 leading to adjustable linkages 164 and cam follower 175. Similarly, plate 83 is attached to pivotal rod 171 which is connected via adjustable linkages 172 to cable 173 leading to adjustable linkages 174 and cam follower 175. As cam 156 on shaft 150 rotates, it imparts motion to follower 175. This motion is transmitted through the linkages and cables to rods 161 and 171 causing plates 82 and 83 move such that pressure brackets 91 are facing the oncoming mandrel 20. Upon contact with the mandrel, the pressure brackets cause tabs 42 to be pushed into slots 77 and openings 43 to be pushed over buttons 78. Once this is accomplished, cam 156 is calibrated to move cam follower 175, and this motion is transmitted through the linkages and cables causing pivotal rods 161 and 171 to move pressure plates 82 and 83 out of the way. This allows the newly-formed container to be free for ejection from the machine.

DESCRIPTION OF THE PREFERRED EMBODIMENTS

In the preferred embodiment, the sidewalls 71 can be made of molded polypropylene although other plastic materials such as ABS, polystyrene, polycorbonates and glass filled nylons or non-plastic materials can be used. The panel wrap 45 can be made of any appropriate material including plastic, fiberboard, corrugated cardboard, or another suitable recyclable material.

The sidewall hoppers and the overhead delivery guides, and the vacuum feed should be angled in order to urge the lowermost panel contained therein into the machine.

Shoes 22 and 26 (and 24 and 28) should be positioned so that they will be just above surfaces 72 of sidewalls 71 in order to frame the sidewalls as they pass through the machine. Similarly, shoes 23 and 27 (and 25 and 29) should be positioned more closely together than shoes 22 and 26 (and 24 and 28) so that they are just above the position of wrap 45 once tabs 41 have been pressed into slots 75.

Openings 43 in wrap 45 should be slightly smaller than the diameter of buttons 76 and 78, but these buttons should be tapered and flared in order that openings 43 be easily pushed onto the buttons, but not easily removed.

Extensions 69 should be sized to fit into slots 75, so that flanges 79 hold tabs 41 in place therein. Similarly, flared extensions 94 should be sized to fit into slots 77 so that flanges 79 hold tabs 42 in place therein.

It is preferred that the mandrel be provided with a set of four capture pins 21 to hold the middle portion of the wrap in position while shaping the container.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

We claim:

1. An improvement to a machine having a mandrel movably mounted on a path for forming containers of a type having two sidewalls attached to a panel wrap using peripheral locking tabs and corresponding slots in which said tabs include openings designed to be engaged over corresponding buttons in said slots, said improvement comprising a pair of end pressure plates provided at the end of said path, each such plate including a plurality of elongated mounting brackets, each such bracket including an opening at one end and having a member attached to the outside thereof for pushing a tab on said panel wrap into a corresponding slot on one of said sidewalls, and for simultaneously engaging the opening in said tab over the corresponding button in said slot.

2. The improvement of claim 1 wherein a slidably mounted spring biased cylindrical pressure imparting member is provided in the opening of each of said mounting brackets, said member having an annular opening at one end for pushing an opening in a tab on said panel wrap over a button in a corresponding slot on one of said sidewalls.

3. A method for forming containers of a type having two sidewalls each sidewall having a plurality of peripheral slots with buttons that are attached to a panel wrap having corresponding locking tabs with openings therein using a machine having a mandrel movably mounted on a path comprising the steps of:

a moving said mandrel along said path;

b. delivering two sidewalls to the sides of said moving mandrel on opposite sides of said path;

c. delivering a panel wrap into the path of said forwardly moving mandrel and sidewalls;

d. deforming said panel wrap around said sidewalls;

e. pressing the tabs of said panel wrap into the corresponding slots on said sidewalls; and f. engaging the openings in said tabs over the corresponding buttons in said slots for forming a container.

* * * * *